US005662365A

United States Patent [19]

Ghostley

[11] Patent Number: 5,662,365

[45] Date of Patent: Sep. 2, 1997

[54] LOCKSET

[75] Inventor: Thomas J. Ghostley, Anaheim, Calif.

[73] Assignee: Emhart Inc., Newark, Del.

[21] Appl. No.: 668,787

[22] Filed: Jun. 21, 1996

[51] Int. Cl.[6] ..... E05B 9/00

[52] U.S. Cl. ..... 292/337; 292/DIG. 53

[58] Field of Search ..... 292/337, DIG. 51, 292/DIG. 38, DIG. 60, DIG. 53

[56] References Cited

U.S. PATENT DOCUMENTS

| | | | |
|---|---|---|---|
| 1,505,380 | 8/1924 | Dexter | 292/337 |
| 2,327,070 | 8/1943 | Schlage | 292/337 |
| 2,410,462 | 11/1946 | Schlage | 292/337 |
| 2,961,264 | 11/1960 | Hillgren | 292/337 X |
| 2,983,540 | 5/1961 | Check | 292/337 |
| 3,055,691 | 9/1962 | Kessel | 292/337 |
| 4,372,594 | 2/1983 | Gater | 292/337 |
| 5,039,146 | 8/1991 | Lin | 292/337 |
| 5,211,432 | 5/1993 | Lin | 292/337 X |
| 5,308,131 | 5/1994 | Galindo et al. | 292/337 |
| 5,570,912 | 11/1996 | Mullich | 292/337 X |

*Primary Examiner*—Rodney M. Lindsey

[57] ABSTRACT

A latch assembly for a lockset is disclosed comprising a cylindrical bolt including at least one axially extending flat portion and a cylindrical casing which is to be inserted into matched bore in a door and which includes a bore for receiving the bolt. The bolt and bore include cooperating structure for maintaining a desired orientation of the bolt relative to the bore as the bolt is displaced from an extended position to a retracted position. A cylindrical adaptor is provided for effectively increasing the diameter of the cylindrical casing including first and second semi-cylindrical portions displaceable into abutting relationship to capture the cylindrical casing and to define a selectively sized outer diameter. The semi-cylindrical portions are releasably secured together when they abut and have a radially inwardly extending end portion which together define an opening selectively configured to matingly receive the cylindrical bolt thereby defining a facing for the cylindrical casing. The semi-cylindrical portions and the cylindrical casing also include cooperating structure for establishing a desired longitudinal position of the semi-cylindrical portions relative to the cylindrical casing.

3 Claims, 3 Drawing Sheets

LOCKSET

The present invention relates to cylindrical locksets and particularly to the latch portion of such locksets.

Cylindrical locksets usually include interior and exterior operators which can be rotated to retract a latch to release the lock. The latch includes a casing or barrel which is retained within a latch bore defined in the door and a bolt is supported by the casing for displacement from a normally protruding position to a withdrawn position which releases the door. The opening of the latch bore is dressed with a suitable faceplate. The faceplate can be a rectangular plate with square or rounded corners or circular. Conventionally when the faceplate is rectangular, the diameter of the casing is ⅞", but when the faceplate is circular, the diameter of the casing is 1".

It is an object of the present invention to provide an improved adaptor for converting the ⅞" casing into a 1" casing and for defining the circular faceplate for dressing the latch bore.

Other objects and advantages of the present invention will become apparent from the following portion of this specification and from the accompanying drawings which illustrate, in accordance with the mandate of the patent statutes, a presently preferred embodiment incorporating the principles of the invention.

Referring to the drawings.

Figure 1:
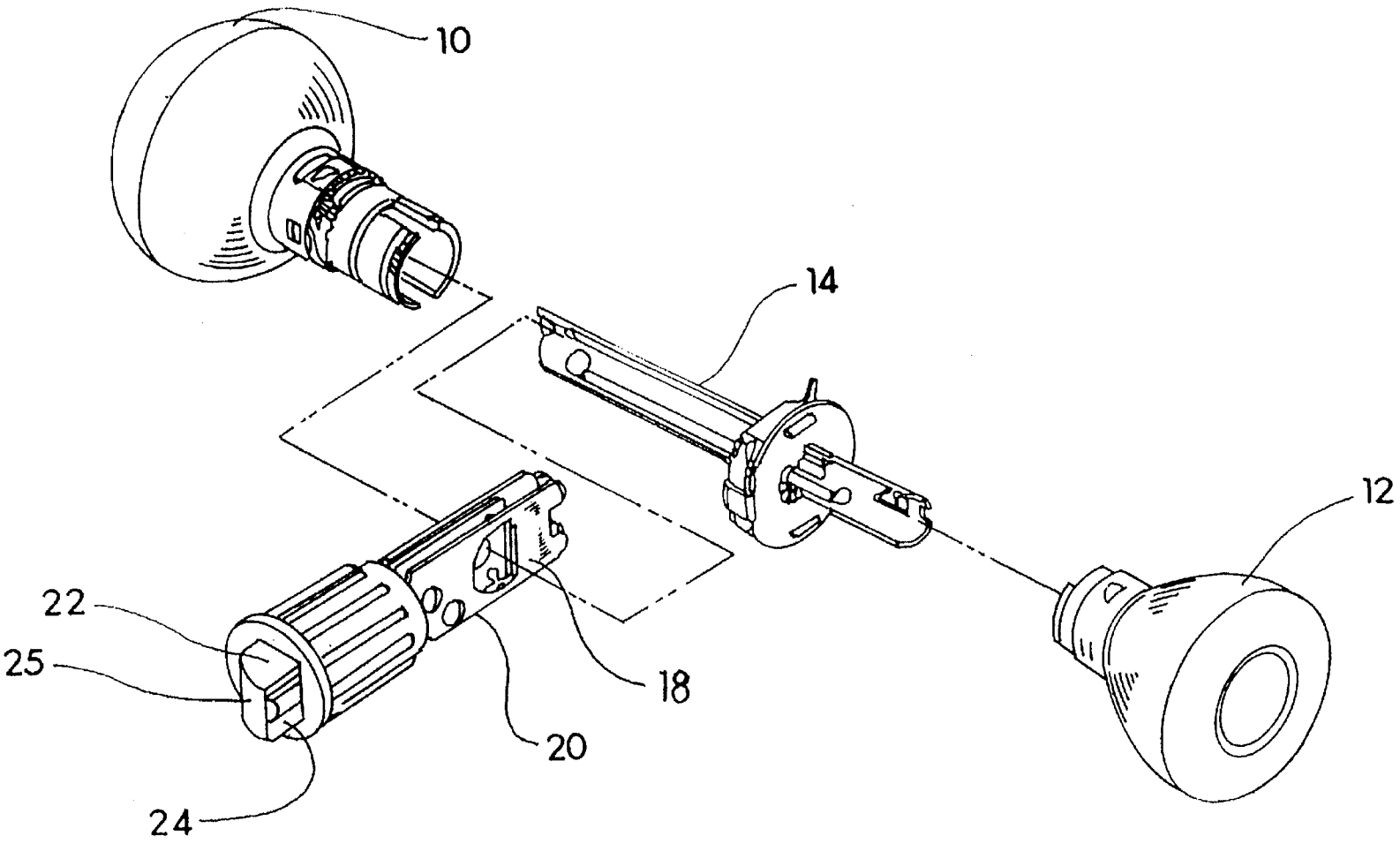
FIG. 1 is an oblique view illustrating some of the components of a cylindrical lock made in accordance with the teachings of the present invention.
Figure 2:
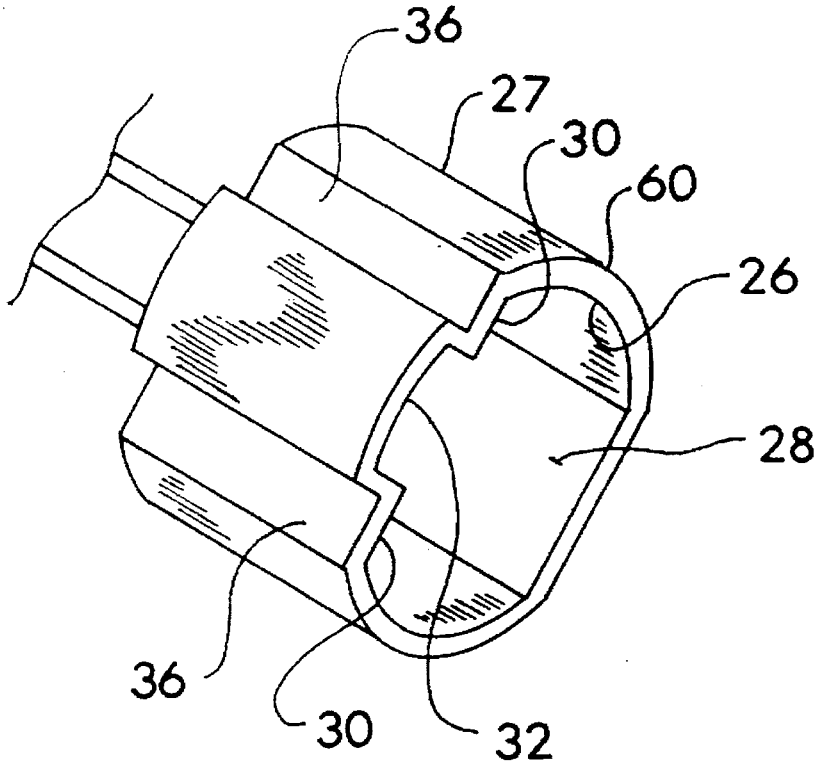
FIG. 2 is an oblique view of the end portion of the casing of the latch assembly shown in FIG. 1, from one side of the casing.
Figure 3:
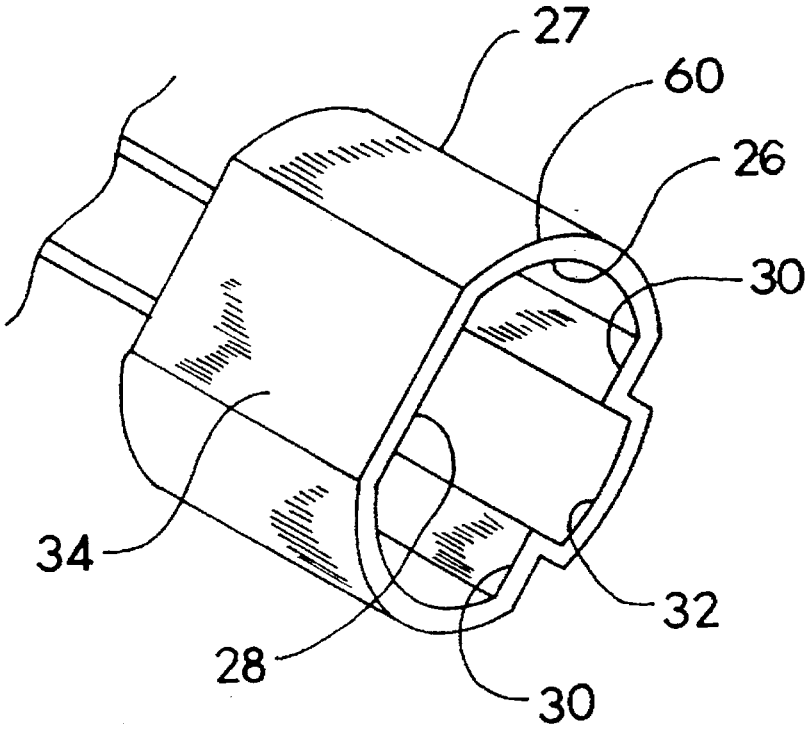
FIG. 3 is a similar view taken from the other side of the casing.
Figure 4:
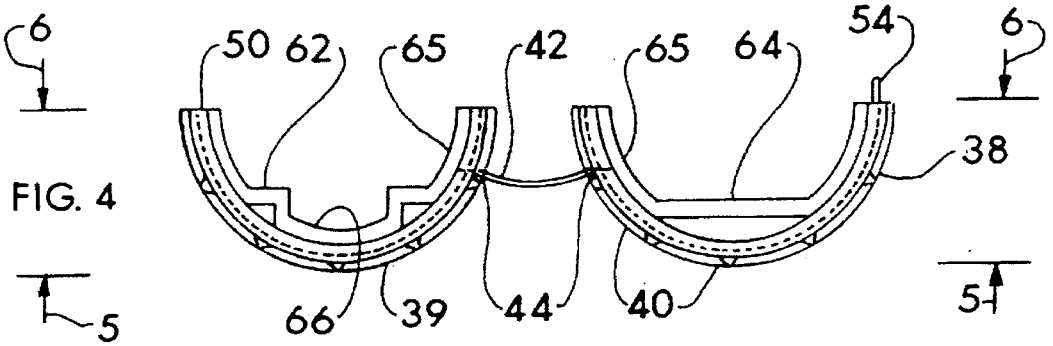
FIG. 4 is a view taken from one end of the casing adaptor shown in FIG. 1 when the adaptor is in the as made condition.
Figure 5:
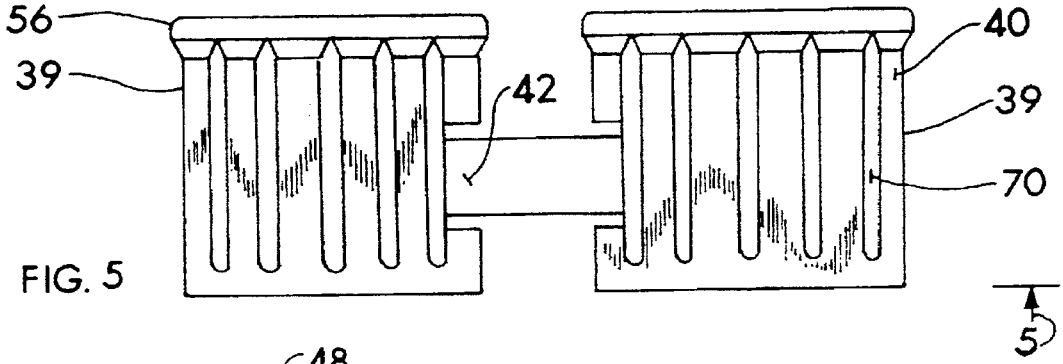
FIG. 5 is a view of the adaptor shown in FIG. 4, taken at lines 5—5 thereof.
Figure 6:
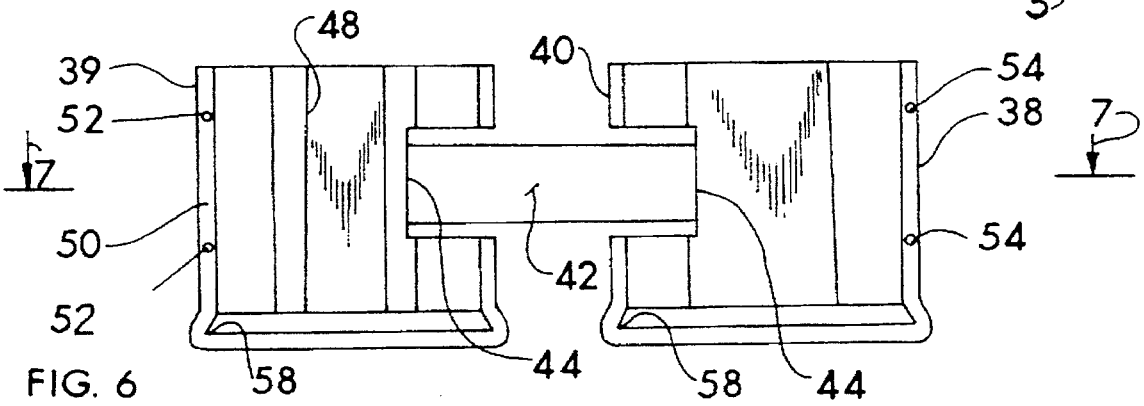
FIG. 6 is a view of the adaptor shown in FIG. 5, taken at 6—6 thereof.
Figure 7:
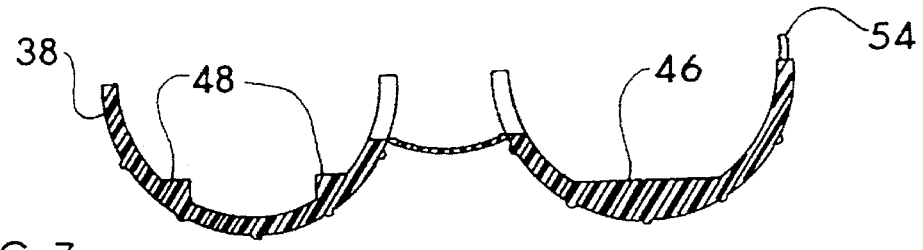
FIG. 7 is a view of the adaptor shown in FIG. 6, taken at 7—7 thereof.

The interior 10 and exterior 12 operators (shown as knobs) of a cylindrical lockset are shown in FIG. 1. These operators are operatively associated with a half round 14 which is located within a similarly configured slot (not shown) in the slide 18 of a latch assembly 20. When an operator is rotated, the half round turns to axially displace the latch slide which retracts the normally extended bolt 22 from a hole in the door jam. The bolt is cylindrical having a flat 24 on one side and may as shown have a narrower flat on the other side. As can be seen from FIGS. 2 and 3, the internal bore 26 of the latch assembly casing 27 has a continuous flat 28 extending-axially on one side and a non continuous wider flat on the other side defined by a pair of parallel spaced flats 30 which also extend axially. The space 32 between the spaced flats is provided so that the latch assembly may have an auxiliary bolt if desired. Since the casing is die cast, the exterior configuration of the casing will match the interior configuration and will accordingly have an axially extending flat 34 on one side and a pair of spaced, parallel axially extending grooves 36 in the other side. Additional details of this latch assembly are disclosed in U.S. patent application Ser. No. 08/402,668, filed Mar. 13, 1995, now U.S. Pat. No. 5,570,912. The adaptor 38 (FIGS. 4–7), which is made of molded plastic, has two semi-cylindrical portions 39, 40 which are connected by a strap 42 connected to the semi-cylindrical portions at living hinges 44. The strap has a limited ability to stretch so that the adaptor can adjust to casing size variations. The interior cylindrical surface of one of the semi-cylindrical portions has an axially extending flat 46 corresponding to the flat 34 on the casing exterior and the interior cylindrical surface of the other semi-cylindrical portion has a pair of spaced, axially extending ribs 48 corresponding to the casing grooves 36. The axially extending edge 50, remote from the living hinge on one of the semi-cylindrical portions, has a pair of holes 52 for receiving corresponding pins 54 defined on the corresponding edge of the other semi-cylindrical portion. One end of these semi-cylindrical portions is formed with an outwardly projecting ring portion 56 which includes an internal retainer groove 58 for receiving the corresponding annular, outwardly projecting casing end lip 60. This ring portion of each semi-cylindrical portion extends radially inwardly to define an opening which will conform to the outer surface of the bolt. The closed end of each semi-cylindrical portion accordingly has a flat portion 62, 64 corresponding to the flat portions of the bolt. These flat portions 62, 64 join circular portions which conform to the cylindrical portion of the bolt. Where there is an auxiliary bolt a suitable cutout 66 will be defined in the flat portion 62 to be located adjacent the auxiliary bolt. The semi-cylindrical portions may have a black color to provide a finish for the exposed ends. In use this adaptor is wrapped around the end of the casing. The strap permits limited adjustment so that the pins can be inserted into the holes to hold the adaptor in place on the casing at the desired orientation and longitudinal position relative to the casing. The casing with the adaptor can now be driven into a 1" latch bore and the outwardly projecting ring at the end of the semi-cylindrical portions will prevent the casing from being pushed too far into the hole.

I claim:

1. A latch assembly for a lockset comprising a cylindrical bolt including at least one axially extending flat portion, a cylindrical casing which is to be inserted into a matched bore in a door, said casing including a bore for receiving said bolt, said bolt and said casing bore including cooperating means for maintaining a desired orientation of said bolt relative to said casing bore as said bolt is displaced from an extended position to a retracted position, and a cylindrical adaptor for effectively increasing the diameter of said cylindrical casing including first and second semi-cylindrical portions displaceable into abutting relationship to capture said cylindrical casing and to define a selectively sized outer diameter, means for releasably securing said semi-cylindrical portions together when they are in said abutting relationship, and said first and second semi-cylindrical portions each having a radially inwardly extending end portion which together define an opening selectively configured to matingly receive said cylindrical bolt thereby defining a facing for said cylindrical casing, said semi-cylindrical portions and said cylindrical casing including cooperating means for establishing a desired longitudinal position of said semi-cylindrical portions relative to said cylindrical casing.

2. A latch assembly according to claim 1, wherein said end portion further includes a radially outwardly projecting ring portion for limiting the insertion of said cylindrical adaptor into the door bore.

3. A latch assembly according to claim 1, wherein said bolt has two flat portions on opposed sides thereof.

* * * * *